US005629033A

United States Patent [19]

Lienau

[11] Patent Number: 5,629,033

[45] Date of Patent: May 13, 1997

[54] PRESSED EARTH BLOCK MACHINE

[76] Inventor: David Lienau, 469 Camino Hermosa, Corrales, N.M. 87048

[21] Appl. No.: 543,406

[22] Filed: Oct. 16, 1995

[51] Int. Cl.[6] ..... B28B 3/04

[52] U.S. Cl. ..... 425/353; 100/229 R; 100/249; 264/40.5; 264/333; 264/337; 425/168; 425/172; 425/173; 425/260; 425/410; 425/448

[58] Field of Search ..... 425/168, 172, 425/173, 258, 260, 345, 353, 410, 412, 448; 100/229 R, 215, 249, 99, 295; 264/40.5, 333, 337, 338

[56] References Cited

U.S. PATENT DOCUMENTS

| | | | |
|---|---|---|---|
| 661,864 | 11/1900 | Graves | 425/260 |
| 1,997,813 | 4/1935 | Cullen | 425/260 |
| 2,436,176 | 2/1948 | Novello | 425/260 |
| 4,061,453 | 12/1977 | DeSantis | 425/352 |
| 4,346,653 | 8/1982 | Rodak | 100/249 |
| 4,563,144 | 1/1986 | Rose | 425/260 |

*Primary Examiner*—Jay H. Woo
*Assistant Examiner*—Joseph Leyson
*Attorney, Agent, or Firm*—Frank J. Catalano; Scott R. Zingerman

[57] ABSTRACT

A machine for pressing earth into blocks has a rectangular breech and a press foot vertically reciprocally drivable in the breech. A bucking block is horizontally reciprocally drivable into and out of registration with an open upper end of the breech. Portions of the upper surface of the bucking block are tapered upwardly from front to rear and a horizontal bucking bar extends across the breech and bears downwardly against the tapered upper portions of the bucking block when the bucking block is in registration with the breech. The bucking bar can be supported at selectively variable levels above the breech and assures a firm positioning of the block against the force of the earth being compacted by the press foot. A rod extending vertically from and movable with the press foot cooperates with a sight line device fixed to the machine to facilitate visual determination of the elevation of the press foot within the breech. This facilitates resetting the lowermost level of the press foot so that blocks of constant depth and density can be made regardless of the composition of the earth used. A neoprene pad on the press foot minimizes adhesion between the press foot and the earth pressed thereby, thus reducing the possibility of crumbling or disintegration of the block as the block is slid off the press foot.

22 Claims, 4 Drawing Sheets

PRESSED EARTH BLOCK MACHINE

BACKGROUND OF THE INVENTION

This invention relates generally to machines for the manufacture of building block and more particularly concerns machines for making blocks of pressed earth.

Presently known pressed earth block machines are deficient for several reasons. One problem is that the bucking block against which the earth is pressed is braced against a high friction device. This can result in severe weakening of the bucking block assembly as well as irregular geometry in the building blocks. Another problem is that known machines press the earth either until compression ceases or until the press stroke has traveled a fixed distance. Due to variations in the consistency of the earth being compacted, the former results in blocks of different depths while the latter result in blocks of different density. A third problem is that known press machines produce a relatively high percentage of damaged blocks because the compacted earth adheres to the surface of the press foot used to drive the earth against the bucking block, resulting in crumbling or disintegration of the finished block as it is pushed off the press foot.

It is, therefore, an object of this invention to provide a pressed earth block machine which makes pressed earth blocks of constant density and depth. Another object of this invention is to provide a pressed earth block machine which facilitates the rapid production of uniform earth blocks. Yet another object of this invention is to provide a pressed earth block machine which resists displacement of its bucking block during the pressing process. Similarly, it is an object of this invention to provide a pressed earth block machine having a device fixed against displacement in the direction of the pressing force and engageable with its bucking block during the pressing process. It is further an object of this invention to provide a pressed earth block machine having a bucking block anti-displacement device which is axially adjustable to maximize its effectiveness. Still another object of this invention is to provide a pressed earth block machine which is capable of producing uniform blocks regardless of variations in the composition of the earth being compressed. Similarly, it is an object of this invention to provide a pressed earth block machine having a sight-line assembly facilitating adjustment of the level of the machine press foot to compensate for variations in the compressibility of the earth. And it is an object of this invention to provide a pressed earth block machine having a press foot adapted to reduce the possibility of crumbling and disintegration of the pressed block during its removal from the press foot due to sticking or adhesion of the block to the press foot.

SUMMARY OF THE INVENTION

In accordance with the invention, a machine for pressing earth into blocks has a rectangular breech and a press foot vertically reciprocally drivable in the breech. A bucking block is horizontally reciprocally drivable into and out of registration with an open upper end of the breech. Portions of the upper surface of the bucking block are tapered upwardly from front to rear and a horizontal bucking bar extends across the breech and bears downwardly against the tapered upper portions of the bucking block when the bucking block is in registration with the breech. The bucking bar assures a firm positioning of the block against the force of the earth being compacted by the press foot.

A feed drawer is fixed to the forward portion of the bucking block. In a cycle of operation, the drawer moves with the bucking block in a forward direction from an earth loading position through an earth unloading position to a drawer stop position which occurs concurrently with registration of the bucking block with the breech. In the same cycle, the drawer moves with the bucking block in a rearward direction back to the earth loading position. As the drawer moves in a forward direction, it pushes a completed block from the previous cycle off the press foot until the drawer reaches the stop position.

A hopper feeds loose earth through the open upper end of the drawer when the drawer is in the earth loading position. A plate fixed to and extending rearwardly of the bucking block closes the hopper when the drawer is in the stop position. Another plate extending rearwardly of the upper portion of the breech closes the feed drawer open bottom when the drawer is in the earth loading position.

Preferably, the bucking bar is mounted for rotation about its longitudinal axis so as to facilitate sliding of the bucking block into position under the bucking bar. Furthermore. the bucking bar mounting is adapted to permit the bar to be supported at selectively variable levels above the breech. Preferably, angularly rotatable bushings eccentrically support the ends of the bucking bar and the bushings can be secured in any selected angular position to set the height of the bucking bar.

Preferably, a device is attached to the press foot which facilitates visual determination of the elevation of the press foot within the breech. For example, a rod extending vertically from and movable with the press foot cooperates with a sight line device fixed to the machine. Preferably, the rod is J-shaped, the shorter leg extending downwardly from a lower surface of the press foot and the longer leg extending upwardly outside of the breech to a level above the sight line device. Level indicia such as a sliding ring is securable in place at a selected level on the rod by a set screw or the like. Visual alignment of the ring with the sight line device allows the operator to position the press foot at the desired level. Graduated markings can be etched in the rod to facilitate positioning of the ring at the desired level. The sight line assembly facilitates resetting the lowermost level of the press foot so that blocks of constant depth and density can be made regardless of the composition of the earth used.

Preferably, the press foot has a neoprene pad or other means fixed to its upper surface for minimizing adhesion between the press foot and the earth pressed thereby. A recess in the upper surface of the press foot allows the pad to be seated flush with the upper perimeter of the press foot. The pad reduces the possibility of crumbling or disintegration of the block due to adhesion or sticking of the block to the press foot as the block is slid off the press foot by the feed drawer.

BRIEF DESCRIPTION OF THE DRAWINGS

Other objects and advantages of the invention will become apparent upon reading the following detailed description and upon reference to the drawings in which.

Figure 1:
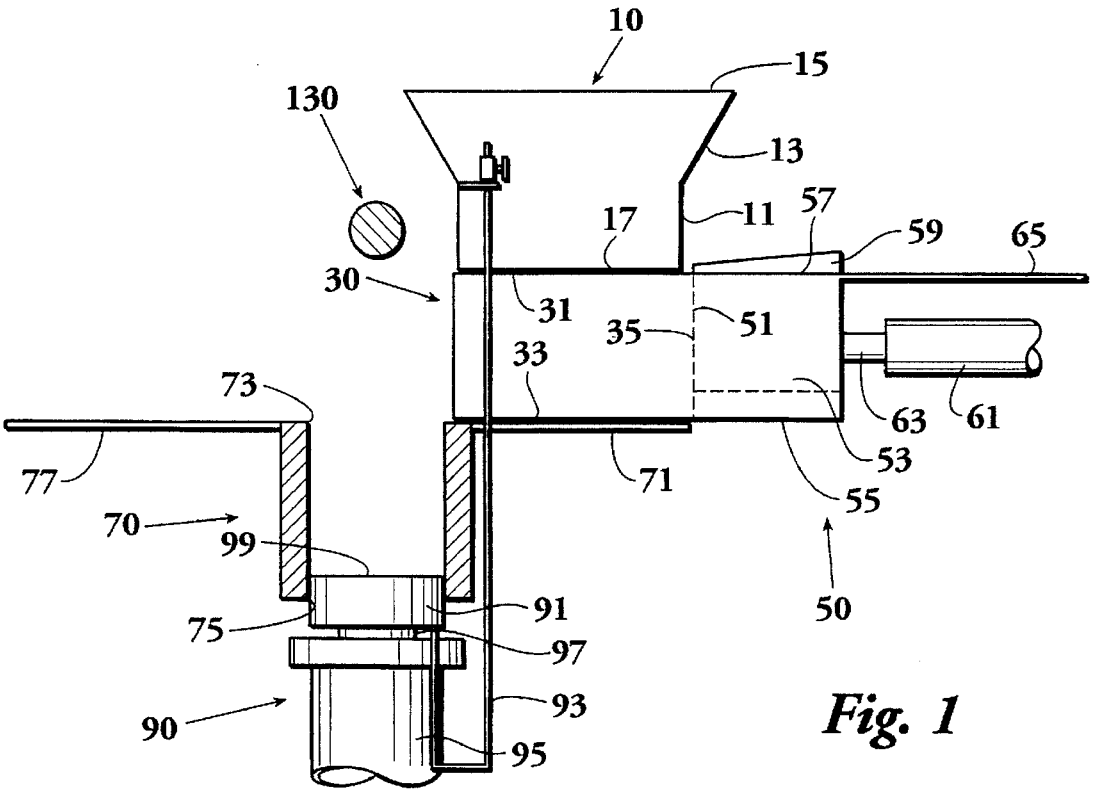
FIG. 1 is a side elevation general arrangement drawing illustrating a preferred embodiment of the pressed earth block machine in an earth loading position.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Turning to FIGS. 1 through 4, the general arrangement of a preferred embodiment of the pressed earth block machine is illustrated in several positions of a single cycle of its operation. The basic components of the machine are the hopper assembly 10 which feeds loose earth into a distribution drawer 30 which is horizontally driven by a bucking block assembly 50 into registration with a breech 70 in which the earth is compacted by a press foot assembly 90 driven vertically against the bucking block assembly 50 which is in turn braced in place by a bucking bar assembly 130.

The earth loading position of an operating cycle is shown in FIG. 1. As shown, the hopper assembly 10 includes an opened bottomed rectangular storage chamber 11 and a rectangular cross-section loading funnel 13 tapering downwardly from a wider mouth 15 at the top of the hopper assembly 10 to the storage chamber 11. The hopper assembly 10 is fixed in position on the frame (not shown) of the machine in any suitable fashion. The distribution drawer 30 is rectangular in cross-section and has an open top 31 and an open bottom 33. In the earth loading position shown in FIG. 1, the distribution drawer 30 is aligned in registration with the storage chamber 11 of the hopper assembly 10 so that loose earth in the hopper assembly 10 will freely flow into the distribution drawer 30 to completely fill the distribution drawer 30. A plate 71 extending rearwardly of the breech 70 closes the open bottom 33 of the drawer 30 during the earth loading process. Preferably, the configuration of the open top 31 of the distribution drawer 30 will be substantially the same as the open bottom 17 of the hopper assembly 10. The back wall 35 of the distribution drawer 30 is mounted against the front face 51 of the bucking block 53. The bottom face 55 of the bucking block 53 lies in substantially the same plane as the open bottom 33 of the distribution drawer 30. The upper face 57 of the bucking block 53 lies substantially in the same plane as the open top 31 of the distribution drawer 30. However, the bucking block 53 is wider than the distribution drawer 30 and has portions 59 which extend laterally of the storage chamber 11 and taper upwardly from the front toward the rear of the bucking block 53. The bucking block assembly 50 is completed by an hydraulic cylinder 61 having a piston rod 63 to reciprocally drive the bucking block 53 and the drawer 30 in the forward and backward horizontal directions. When the bucking block 53 is driven in a forward direction, the top face 57 closes the open bottom 17 of the hopper assembly 10 while the tapered portions 59 of the bucking block 53 will pass laterally outside of the storage chamber 11.

The breech 70 consists of four walls rectangularly arranged to provide an open top and an open bottom 75,the dimensions of the rectangle being typically the length and width of the earth block to be pressed. The depth of the earth block is in part a function of the level of the press foot 91 of the press foot assembly 90 when loose earth is admitted into the breech 70. That is, the position of the press foot 91 when earth is admitted into the breech 70 determines the volume of the breech 70 and therefore the amount of earth that will be compacted. The level of the press foot 91 is set by the operator by use of the sight line device 93 which will be hereinafter discussed in greater detail. Suffice it to say that the operator will manually control the hydraulic cylinder 95 and piston rod 97 to set the level of the press foot 91 in response to a visual observation indicative of the level of the press foot 91 in the breech 70.

Figure 2:
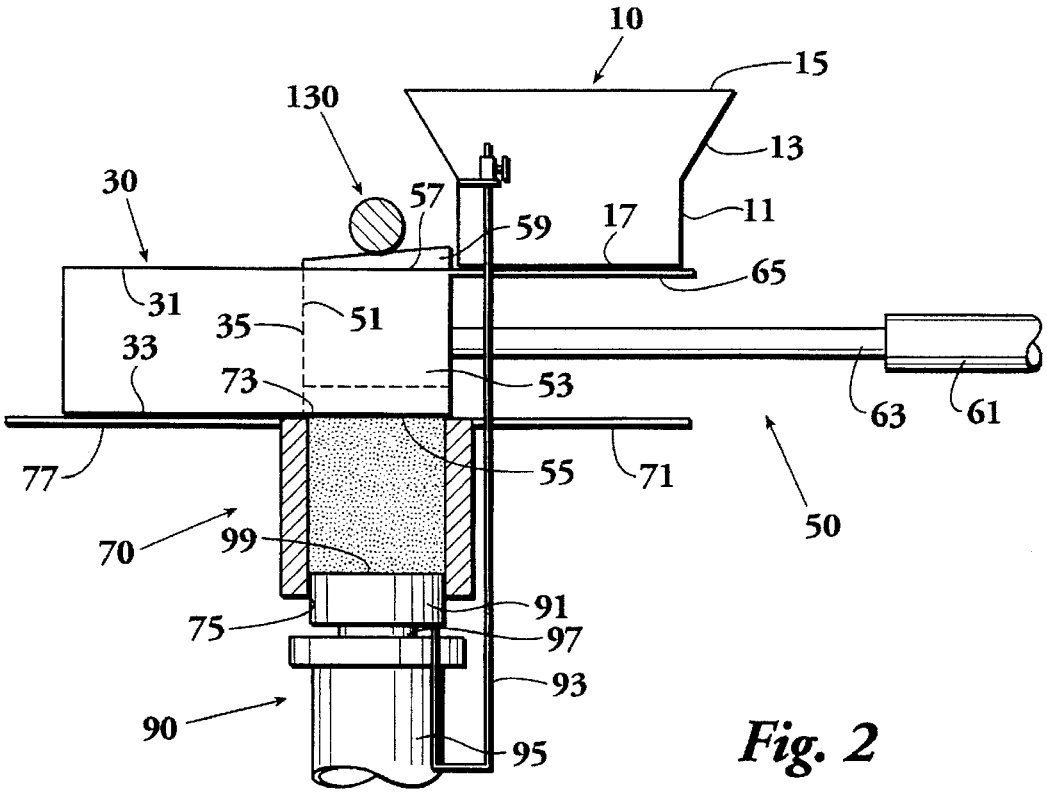
FIG. 2 is a side elevation general arrangement drawing illustrating a preferred embodiment of the pressed earth block machine in an earth unloading position.

When the distribution drawer 30 is full, the hydraulic system of the bucking block assembly is activated to drive the piston rod 63, the bucking block 53 and the drawer 30 in a forward direction to fill the breech 70. As seen in FIG. 2, as the piston rod 63 drives the bucking block 53 and the drawer 30 in a forward direction, loose earth is dropped through the open bottom 33 of the drawer 30 into the breech 70 and on top of the press foot 91. As the bucking block 53 slides under the open bottom 17 of the hopper assembly 10, the bucking block 53 begins to close the open bottom 17. A plate 65 extending rearwardly of the block 53 and substantially parallel with its top face 57 completes the closing process and fully closes the open bottom 17 of the hopper assembly 10 when the block 53 has been moved into registration with the breech 70. During the course of forward motion of the block 53, as the block 53 passes over the open top 73 of the breech 70, it levels the earth as it passes. When the block 53 is in registration with the breech 70, the earth unloading portion of the cycle is complete.

Figure 3:
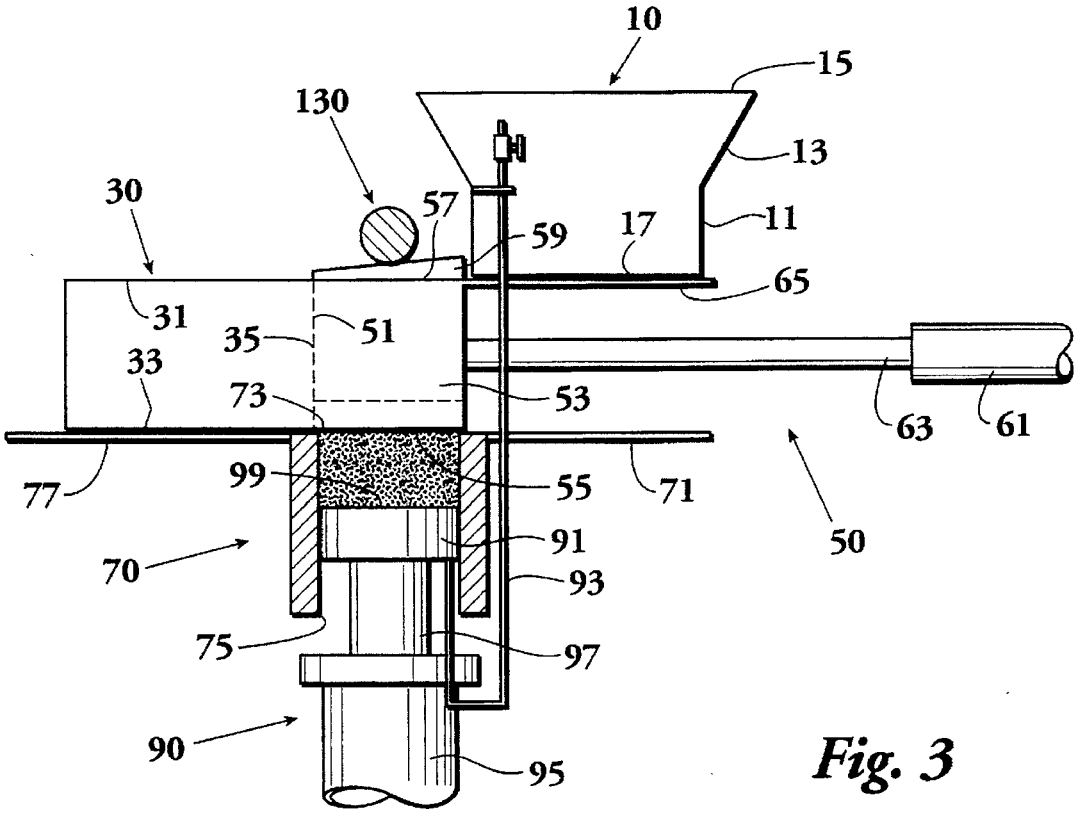
FIG. 3 is a side elevation general arrangement drawing illustrating a preferred embodiment of the pressed earth block machine in a block completed position.

Turning now to FIG. 3, pressing of the block is accomplished by operation of the press foot hydraulic system to drive the piston rod 97 and the press foot 91 upwardly against the loose earth which is compacted against the bottom face 55 of the bucking block 53. As shown, when the bucking block 53 slides into registration with the breech 70, the tapered portions 59 of the bucking block 53 slide under and into abutment with the bucking bar 131 which presses the bucking block 53 downwardly against the breech 70. Thus, as the press foot 91 compacts the earth against the bottom face 55 of the bucking block 53, the bucking bar 131 secures the bucking block 53 against displacement vertically in relation to the breech 70 and forwardly in relation to the bucking bar 131 while the hydraulic system of the bucking block assembly 50 prevents rearward displacement of the bucking block 53.

Figure 4:
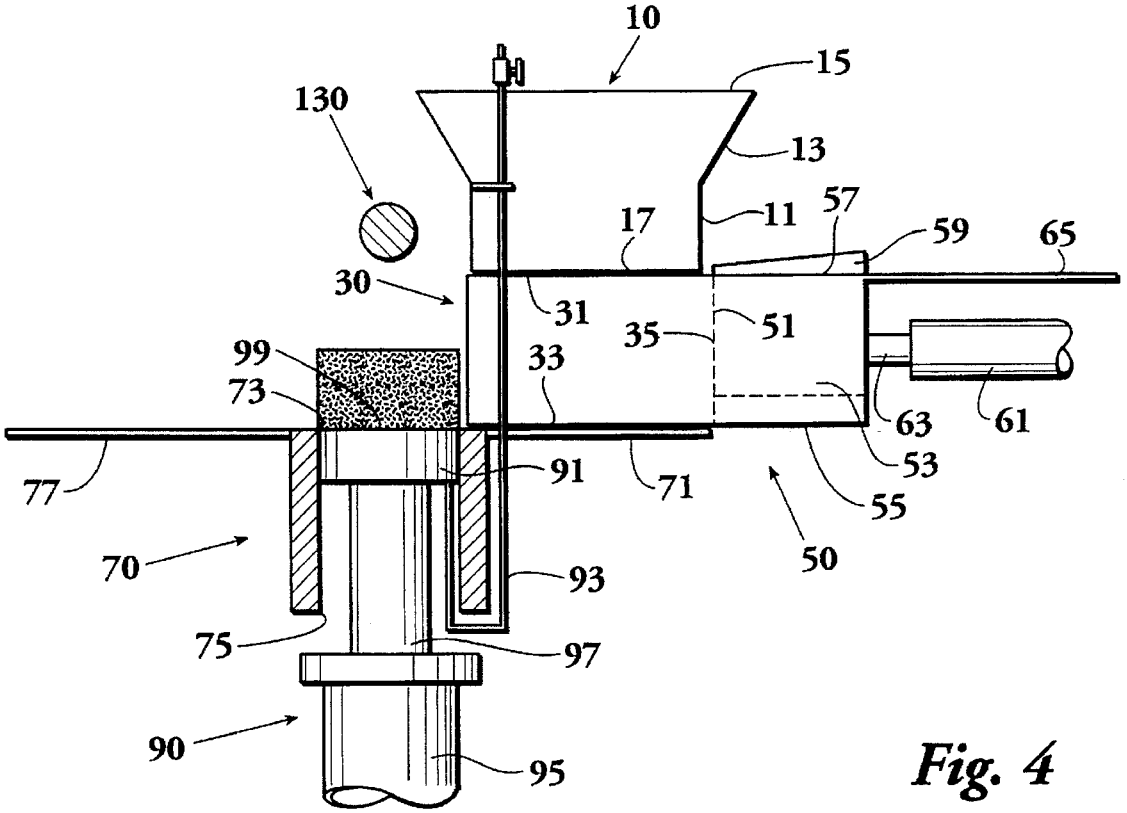
FIG. 4 is a side elevation general arrangement drawing illustrating a preferred embodiment of the pressed earth block machine in a block ejected position.

Turning to FIG. 4, when the block is fully pressed, the hydraulic system of the bucking block assembly 50 is activated to move the piston rod 63, the bucking block 53 and the drawer 30 in a rearward direction back to the earth loading position in which the drawer 30 is in registration with the storage chamber 11 of the hopper assembly 10. The hydraulic system of the press foot assembly 90 is then actuated to drive the piston rod 97 and the press foot 91 upwardly until the top 99 of the press foot 91 is level with the top 73 of the breech 70.

When the drawer 30 is fully reloaded with loose earth, another cycle is initiated as explained in relation to FIG. 1, and front end of the distribution drawer 30 pushes the completed block off the press foot 91 and onto another plate 77 extending forwardly of the breech 70 as an unloading table for the block. The table 77 closes the bottom of the drawer 30 when the drawer 30 is in the earth unloading position so that loose earth in the drawer 30 in excess of the volume of the breech 70 is retained in the drawer 30.

Figure 5:
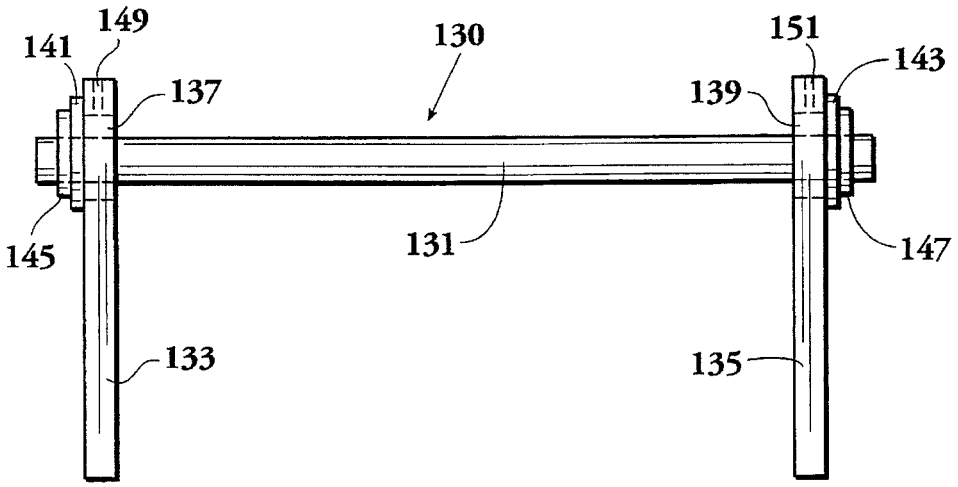
FIG. 5 is a front elevation view of a preferred embodiment of the bucking bar assembly of the pressed earth block machine.
Figure 6:
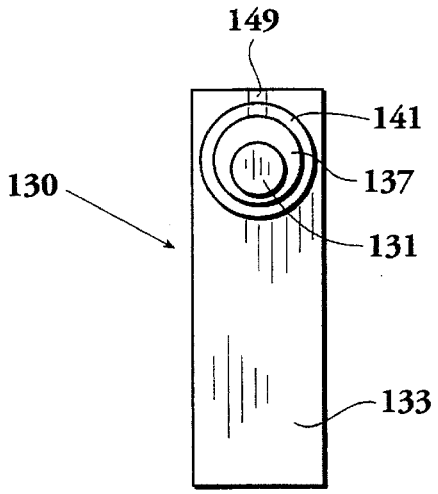
FIG. 6 is a side elevation view of the assembly of FIG. 5.

Turning to FIGS. 5 and 6, a preferred embodiment of the bucking bar assembly 130 is shown in greater detail. The bucking bar 131 is supported at either end by a pair of posts 133 and 135. Holes are provided through each of the posts 133 and 135 into which bushings 137 and 139 are inserted. Each of the bushings 137 and 139 has a flange 141 and 143 around its outer peripheral edge which prevents the bushings 137 and 139 from sliding through the posts 133 and 135. As shown, the bucking bar 131 extends through eccentric holes in the bushings 137 and 139. Locking rings 145 and 147 secured to the bucking bar 131 by set screws (not shown) assure that the mounted bucking bar 131 will not slide laterally between the posts 133 and 137. However, the bucking bar 131 is free to rotate about its longitudinal axis within the eccentric holes in the bushings 137 and 139. The bushings 137 and 139 are rotated to seat the elevation of the bucking bar 131. This allows adjustment to compensate for wear on the bucking bar 131 or the tapered portions 59 of the bucking block 53 resulting from extended use of the machine. Set screws (not shown) in threaded apertures 149 and 151 which extend from the outer edges of the posts 133 and 135 to the bushing holes allow the bushings 137 and 139 to be secured in any angular position relative to the longitudinal axis of the bucking bar 131 and thus fix the elevation of the bucking bar 136.

Figure 7:
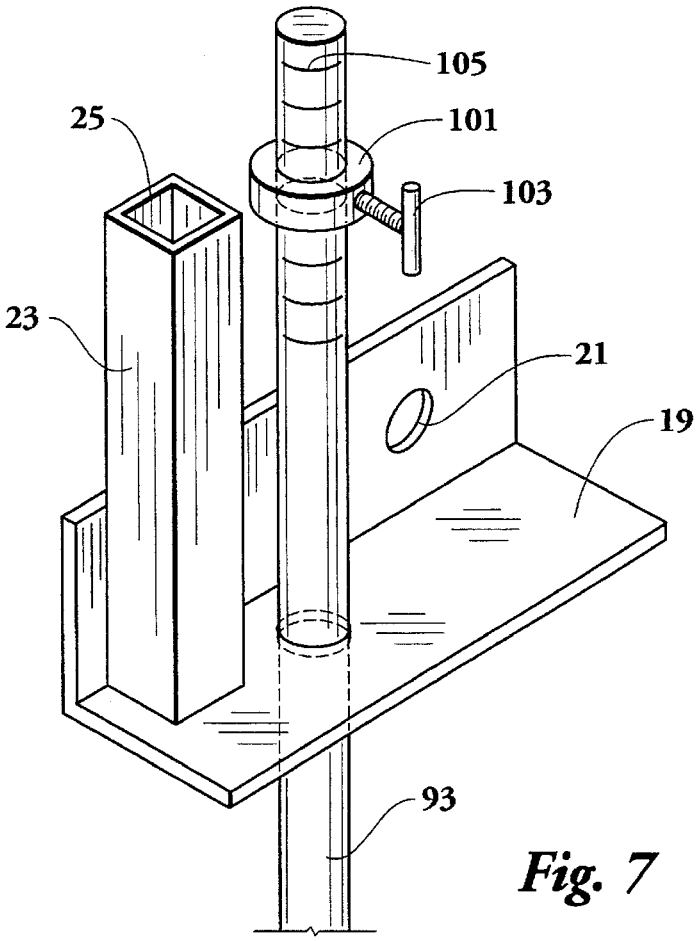
FIG. 7 is a perspective view illustrating the depth/density control assembly of the pressed earth block machine.

Turning to FIG. 7, the sight line device of the press foot assembly 90 is illustrated in greater detail. In this preferred embodiment of the device, the rod 93, as shown in FIGS. 1 through 4, is preferably bent in a J configuration with the short leg extending downwardly from the press foot 91 and the long leg extending upwardly to the hopper assembly 10. A bracket such as an angle iron 19 is fastened to the machine frame (not shown) or to the hopper assembly 10 by use of a mounting hole 21 which receives a bolt (not shown). A section of square tubing 23 or other member extends vertically upwardly from the bracket 19 to a flat upper end 25 defining a horizontal sight plane. A ring 101 slidably mounted on the rod 93 above the bracket 19 is fitted with a handled set screw 103 so that the ring can be secured at any selected elevation on the rod 93. Graduated indicia 105 can be provided on the rod 93 to facilitate positioning of the ring 101. In operating the sight line device, the operator first sets the sliding ring 101 at a likely graduation level 105 on the rod 93 to produce a block of a desired depth. The operator then activates the hydraulic system of the press foot assembly 90 until the top of the ring 101 is level with the sight plane 25. The machine is then operated through its cycle to make a block and the depth of the completed block is measured. If the actual depth of the block is different than the desired depth of the block, the operator will turn the handled set screw 103 to release the ring 101 and move the ring 101 to a different graduated indicia 105 to raise or lower the height of the press foot 91 so as to permit more or less loose earth to be admitted into the breech 70, depending on whether the block was too thin or too thick, respectively. By one or more repetitions of this process, the height of the press foot 91 can be adjusted to provide blocks of uniform density and uniform selected depth for any composition of loose earth being used.

Figure 8:
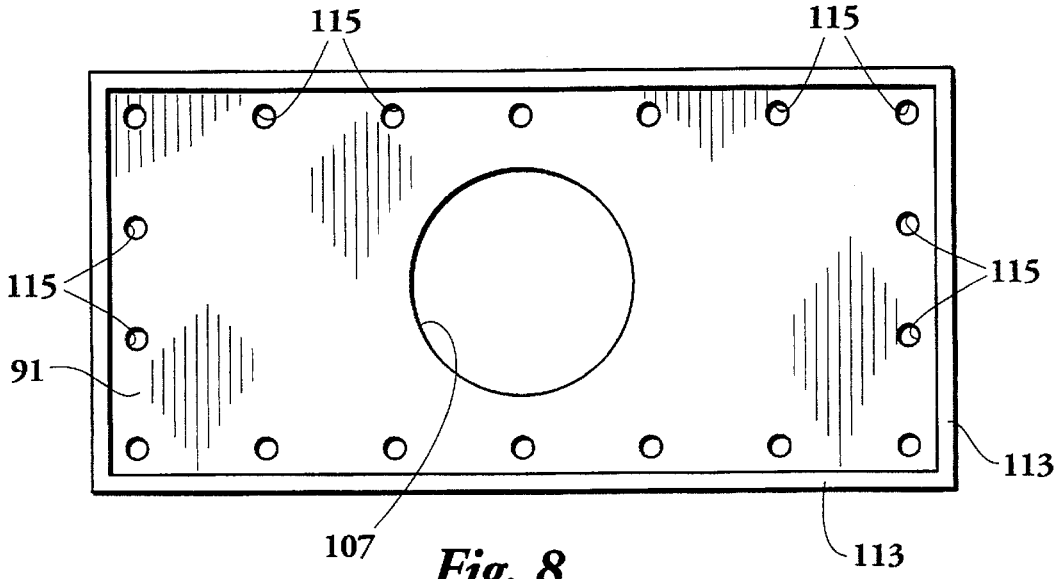
FIG. 8 is a top plan view of a preferred embodiment of the press foot of the pressed earth block machine.
Figure 9:
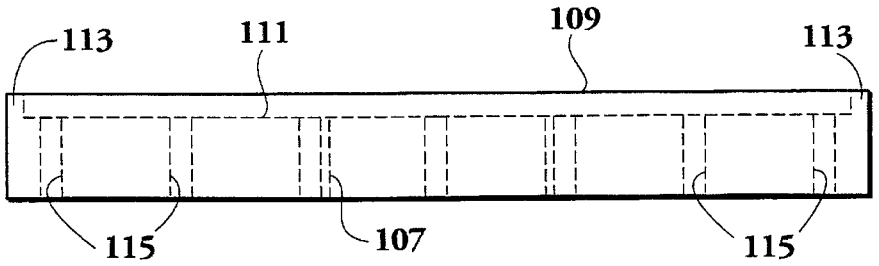
FIG. 9 is a side elevation view of the press foot of FIG. 8.
Figure 10:
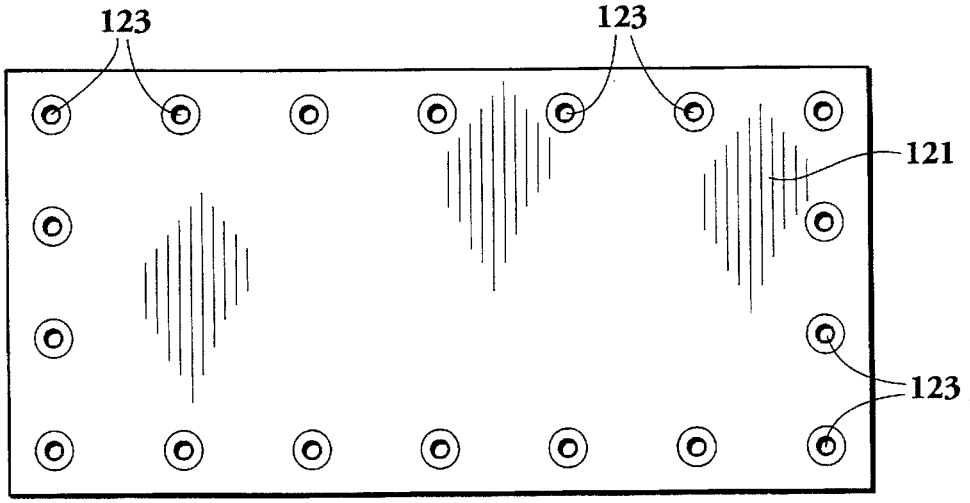
FIG. 10 is a top plan view of a pad for use with the press foot of FIGS. 8 and 9.

Looking now at FIGS. 8 through 10, a preferred embodiment of the press foot 91 is illustrated. As shown, the press foot 91 is a rectangular member having a central aperture 107 for receiving the upper end of the piston rod 97 of the press foot assembly 90. The junction is secured by welds. Preferably, the upper face 109 of the press foot 91 has a flat seat 111 extending substantially across its entire area and leaving a rim 113 extending around the upper portion of the press foot 91. Within the area of the seat 111, a plurality of threaded holes 115 are tapped into the press foot 91, preferably equally spaced apart about its perimeter. The depth of the seat 111 is such that a pad 121 can be nestled snugly in the seat 111 with its upper surface flush with the outer rim 113 of the press foot 91. A plurality of bolts 123 can then be tightened through holes in the pad 121 and into the threaded holes 115 in the press foot 91 to secure the pad 121 in place.

Preferably, the compression ratio of the machine will be set at fifty percent so that blocks of approximately 3½ inches in depth will be formed when the depth of the press foot 91 below the top 73 of the breech 70 is approximately 7 inches. It has been found that the depth of the blocks can be accurately established by the above-described trial and error method by the making of three or four blocks. A typical breech 70 will be 5½ inches wide by 12 inches long, an internationally accepted size for block, and the depth will typically be established at from two to four inches. The pad 121 will typically be made of ⅜ inch thick layered neoprene belt. As shown, eighteen ¼ inch by 20 inch stainless steel bolts 123 are used to secure the pad 121 to the press foot 91. A ⅛ inch rim 113 about the press foot 91 is preferred. Preferably, the breech 70, the bucking bar 131, the bucking block 53 and the press foot 91 will all be made of steel and the J-rod 93 will be a ½ inch by 36 inch galvanized rod bent to approximately 6 inch and 25 inch arms separated by a 4½ inch base. The drawer 30 and the bucking block assembly 50 will preferably ride on alloy dry linear bearings (not shown) rolling on one inch diameter chrome plated rods (not shown). Preferably, the level of the bucking bar 131 will be set so that the bucking bar 131 will drive the bucking block 53 downwardly approximately 0.030" into firm abutment against the top 73 of the breech 70. Also preferably, the adjustable eccentric bushings 137 and 139 provide in a range of0.128" eccentricity. A suitable hydraulic system would include a five horsepower gas engine such as Kohler's OHV 5HP Command Engine; a two-stage pump such as TSB's 11GPM Two Stage Pump and a two-spool hydraulic directional control valve such as Prince's Model RD5200. The machine may, however, be electrically or pneumatically driven. A machine made in accordance with the above description has demonstrated a production rate of three blocks per minute.

Thus, it is apparent that there has been provided, in accordance with the invention, a pressed earth block machine that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A machine for pressing earth into blocks comprising:

a rectangular breech having open upper and lower ends;

a press foot vertically reciprocally drivable in said breech;

a bucking block horizontally reciprocally drivable into and out of registration with said open upper end of said breech and having portions of an upper surface thereof tapered upwardly from forward to rearward portions thereof; and a horizontal bucking bar extending across said breech and bearing downwardly against said tapered upper portions of said block when said block is in registration with said breech.

2. A machine according to claim 1 further comprising a feed drawer having an open bottom and fixed to said forward portion of said bucking block for horizontal forward movement therewith from a loading position through an unloading position of registration of said open bottom thereof with said open upper end of said breech to a stop position concurrent with said registration of said block and said breech and for horizontal rearward movement therewith back to said loading position.

3. A machine according to claim 2 further comprising a hopper having an opening in registration with an open upper end of said drawer when said drawer is in said loading position and a plate fixed to and extending rearwardly of an upper portion of said block and closing said hopper opening when said drawer is in said stop position.

4. A machine according to claim 2 further comprising a plate extending rearwardly of said upper end of said breech and closing said feed drawer open bottom when said drawer is in said loading position.

5. A machine according to claim 1, said bucking bar being mounted for rotation about a longitudinal axis thereof.

6. A machine according to claim 5 further comprising means supporting said bar for selectively varying a level thereof above said breech.

7. A machine according to claim 6, said varying means comprising a pair of angularly rotatable bushings, one proximate each end of said bar, said bar being mounted eccentrically in said bushings, and means for securing said bushings in a selected angular position.

8. A machine for pressing earth into blocks comprising:

a hopper;

a rectangular breech having open upper and lower ends;

a press foot vertically reciprocally drivable in said breech;

a bucking block horizontally reciprocally drivable into and out of registration with said open upper end of said breech and having portions of an upper surface thereof tapered upwardly from forward to rearward portions thereof;

a feed drawer having an open bottom and fixed to said forward portion of said bucking block for horizontal forward movement therewith from a first position of registration of an open top thereof with an open bottom of said hopper through a second position of registration of said open bottom thereof with said open upper end of said breech to a third position concurrent with said registration of said block and said breech and for horizontal rearward movement therewith back to said first position;

a first plate fixed to and extending rearwardly of an upper portion of said block and closing said open bottom of said hopper when said drawer is in said third position;

a second plate extending rearwardly of said upper end of said breech and closing said feed drawer open bottom when said drawer is in said first position; and a horizontal bucking bar extending across said breech at a level above a top of said drawer and transversely across a path of motion of said block, said bar bearing against said tapered upper portions of said block when said drawer is in said third position.

9. A machine according to claim 8, said bucking bar being mounted for rotation about a longitudinal axis thereof.

10. A machine according to claim 9 further comprising means supporting said bar for selectively varying a level thereof above said breech.

11. A machine according to claim 10, said varying means comprising a pair of angularly rotatable bushings, one proximate each end of said bar, said bar being mounted eccentrically in said bushings, and means for securing said bushings in a selected angular position.

12. A machine for pressing earth into blocks comprising:

a rectangular breech having open upper and lower ends;

a press foot vertically reciprocally drivable in said breech;

a bucking block horizontally reciprocally drivable into and out of registration with said open upper end of said breech and having portions of an upper surface thereof tapered upwardly from forward to rearward portions thereof;

a horizontal bucking bar extending across said breech and bearing downwardly against said tapered upper portions of said block when said block is in registration with said breech; and means fixed to said press foot for visually determining an elevation of said press foot in said breech.

13. A machine according to claim 12, said determining means comprising a rod extending vertically from said press foot for movement therewith and means fixed to the machine at a constant level for providing a sight line relative to said rod.

14. A machine according to claim 13, said rod being J-shaped, a shorter leg thereof extending downwardly from a lower surface of said press foot and a longer leg thereof extending upwardly outside of said breech to a level above said sight line means.

15. A machine according to claim 14 further comprising means disposed on an upper end of said longer leg for slidable positioning at a selected level thereon and means for securing said positioning means on said leg at said level.

16. A machine for pressing earth into blocks comprising:

a hopper;

a rectangular breech having open upper and lower ends;

a press foot vertically reciprocally drivable in said breech;

a bucking block horizontally reciprocally drivable into and out of registration with said open upper end of said breech and having portions of an upper surface thereof tapered upwardly from forward to rearward portions thereof;

a feed drawer having an open bottom and fixed to said forward portion of said bucking block for horizontal forward movement therewith from a first position of registration of an open top thereof with an open bottom of said hopper through a second position of registration of said open bottom thereof with said open upper end of said breech to a third position concurrent with said registration of said block and said breech and for horizontal rearward movement therewith back to said first position;

a horizontal bucking bar extending across said breech at a level above a top of said drawer and transversely across a path of motion of said block, said bar bearing against said tapered upper portions of said block when said drawer is in said third position; and a J-shaped rod fixed to and extending downwardly from a bottom of said press foot, laterally to a point external of said breech and upwardly to a portion thereof slidably extending through a bracket fixed to said hopper.

17. A machine according to claim 16, said bracket having means fixed thereon providing a sight line relative to said rod.

18. A machine according to claim 17 further comprising means disposed on an upper portion of said rod for slidable positioning at a selected level thereon and means for securing said positioning means on said rod at said level.

19. A machine for pressing earth into blocks comprising:

a rectangular breech having open upper and lower ends;

a bucking block horizontally reciprocally drivable into and out of registration with said open upper end of said breech and having portions of an upper surface thereof tapered upwardly from forward to rearward portions thereof;

a horizontal bucking bar extending across said breech and bearing downwardly against said tapered upper portions of said block when said block is in registration with said breech; and a press foot vertically reciprocally drivable in said breech, said press foot having means fixed to an upper surface thereof for minimizing adhesion between said press foot and earth pressed thereby.

20. A machine according to claim 19, said minimizing means comprising a pad.

21. A machine according to claim 20, said press foot having a recess in an upper surface thereof and said pad being seated in said recess and flush with a perimeter thereof.

22. A machine for pressing earth into blocks comprising:

a hopper;

a rectangular breech having open upper and lower ends;

a press foot vertically reciprocally drivable in said breech;

a bucking block horizontally reciprocally drivable into and out of registration with said open upper end of said breech and having portions of an upper surface thereof tapered upwardly from forward to rearward portions thereof;

a feed drawer having an open bottom and fixed to said forward portion of said bucking block for horizontal forward movement therewith from a first position of registration of an open top thereof with an open bottom of said hopper through a second position of registration of said open bottom thereof with said open upper end of said breech to a third position concurrent with said registration of said block and said breech and for horizontal rearward movement therewith back to said first position;

a horizontal bucking bar extending across said breech at a level above a top of said drawer and transversely across a path of motion of said block, said bar bearing against said tapered upper portions of said block when said drawer is in said third position; and a press foot vertically reciprocally drivable in said breech, said press foot having means fixed to an upper surface thereof for minimizing adhesion between said press foot and earth pressed thereby.

* * * * *